United States Patent [19]

Giffin

[11] 4,320,932

[45] Mar. 23, 1982

[54] VERTICAL BREADBOX OR THE LIKE

[76] Inventor: Lloyd Giffin, 60 Fifth St., Woodland, Calif. 95695

[21] Appl. No.: 143,616

[22] Filed: Apr. 25, 1980

[51] Int. Cl.[3] ..... A47B 81/00; A47G 19/32

[52] U.S. Cl. ..... 312/71; 312/284; 211/49 D; 220/378

[58] Field of Search ..... 312/71, 72, 45, 284; 211/49 D; 220/378; 248/188.9

[56] References Cited

U.S. PATENT DOCUMENTS

| | | | |
|---|---|---|---|
| 187,714 | 2/1877 | King | 220/378 |
| 634,394 | 10/1899 | Conrad | 220/378 |
| 1,683,345 | 9/1928 | Geyer | 220/378 |
| 1,726,121 | 8/1929 | Polkosnik | 248/188.9 |
| 2,448,171 | 8/1948 | Campbell | 211/49 D |
| 2,753,074 | 7/1956 | Schmid | 220/378 |
| 2,802,575 | 8/1957 | Harrison | 312/71 |
| 2,812,990 | 11/1957 | Smith | 312/71 |
| 2,816,808 | 12/1957 | Haines | 312/71 |
| 2,886,918 | 5/1959 | Bayley et al. | 248/188.9 |
| 2,915,353 | 12/1959 | Michaelsen | 312/284 |

*Primary Examiner*—Victor N. Sakran

*Attorney, Agent, or Firm*—Mark C. Jacobs

[57] ABSTRACT

A vertical breadbox for storing stacked slices of unwrapped bread, said breadbox having a top section that meshes into a bottom section, the bottom section comprising a hollow body having upstanding side walls and the top sealingly engaging a chamfered edge of each of the side walls to keep air out and the bread fresh.

7 Claims, 10 Drawing Figures

VERTICAL BREADBOX OR THE LIKE

BACKGROUND OF THE INVENTION

In the 1940's and 1950's, when construction prices were lower, houses had kitchens with a larger number of cabinets than are generally offered today, because the kitchens themselves were larger than are generally available today. As costs of construction have risen, the size of kitchens and the number of cabinets has decreased. Whereas formerly, there was always at least one drawer specifically defined as the bread box, in which were stored cookies, cakes, bread, rolls and the like; today, most kitchens do not possess such a drawer. Today, bread is stored for the long term, in the refrigerator, or in a plastic bag on top of the counter in a very unsightly fashion.

It is seen, therefore, that there is indeed a need for an attractive container which is capable of holding a loaf of bread or at least a part thereof for a reasonable length of time. Such a container should be capable of being placed upon the table, due to its good looks, yet be quite functional in that it seals the bread from outside air, thereby retains the freshness for the bread being stored. The instant invention is seen, therefore, to satisfy the needs of the marketplace by providing an attractive container capable of holding the bread for short or medium term storage, and which container can be readily transported to and from the table as may be desired.

It is one object of this invention, therefore, to provide a container for the storage of bread.

It is another object of this invention to provide a container for the storage of bread wherein the bread may be stored after it has been removed from its packaging. Another object of the invention is to provide an attractive, readily portable bread storage container which seals out the outside air to retain the freshness of the bread.

Still another object is to provide a bread storage container, that allows easy access to the individual slices of bread being stored.

These and other objects of the invention will in part, be obvious and will in part appear hereinafter. The invention accordingly comprises the apparatus possessing the features, properties and the relation of components which are exemplified in the following detailed disclosure and the scope of the application of which will be indicated in the appended claims.

For a fuller understanding of the nature and objects of the invention, reference should be made to the following detailed description taken in conjunction with the accompanying drawings.

DESCRIPTION OF THE PREFERRED EMBODIMENT

Figure 1:
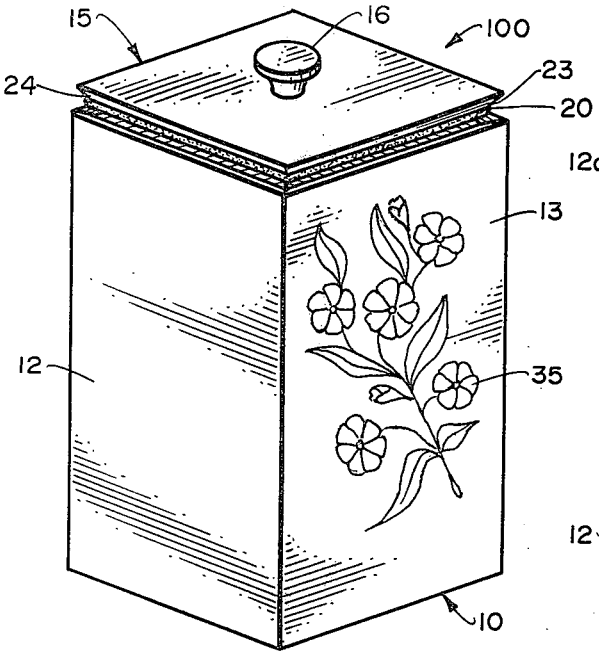
FIG. 1 is a perspective view of the breadbox of this invention, with the top slightly removed from the bottom.
Figure 9:
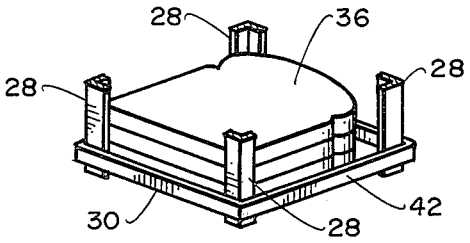
FIG. 9 is a perspective view showing the attachment of the resting plate to the L-sliders.

In FIG. 1 there is shown the device 100 of this invention which is seen to be a vertical breadbox. The top section 15, is shown slightly separated from the bottom section 10 in order to better illustrate the construction of the several parts of this device. Breadbox 100 is seen to comprise a top section 15 and a bottom section 10, wherein the top 15 is intended to removably sealingly engage the bottom 10 such as to seal out external air in order to keep the loaf of bread fresh, several slices of which are seen in FIG. 9 and designated 36. See FIG. 10.

Figure 2:
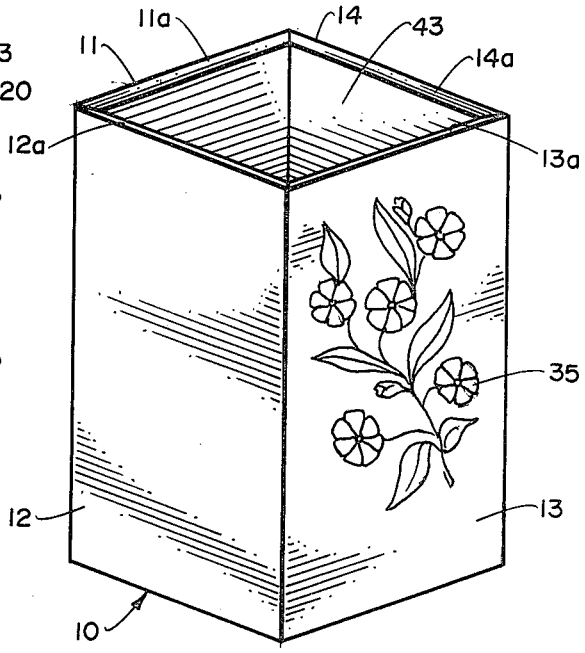
FIG. 2 is a perspective view of the bottom section of the vertical breadbox of this invention.
Figure 4:
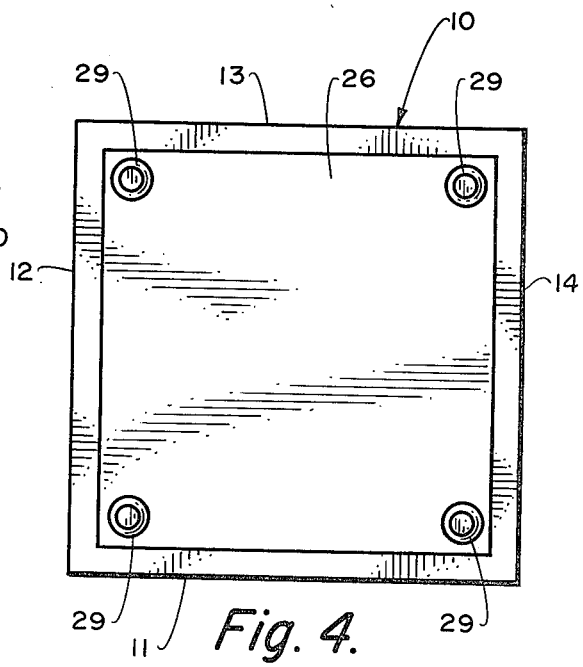
FIG. 4 is a bottom plan view of this device.

Bottom section 10 comprises a hollow body having four upstanding side walls, 11,12,13, and 14, all connected to a bottom wall 26 normally, said body being open at the top, and of rectangular or square cross-section. In the drawings, a square shaped device 100 is illustrated. Each of the side walls 11,12,13 & 14 has its top edge chamfered downwardly and inwardly, each of said chamfers being designated with "a" to correspond to the sidewall. Thus wall 11 has a chamfered edge 11*a* etc. Reference is made to FIGS. 1 and 2. Wall 13 is seen to be decorated with a floral pattern 35 which is illustrative of any type of pattern that may be applied to said side walls and to the outside surface of top 15. The sidewalls aforesaid and the top portion 18 of top 15 may be made of wood, metal, plastic or Masonite as may be desired. Bottom wall 26 may be made of the same materials but is generally not decorated with a design which may be applied by a vinyl film overlay, paint, silkscreen or printing, all of which techniques are known to the art and which form no part of this invention. As is seen in FIG. 4, bottom wall 26 preferably has a plurality of rubber feet attached thereto by known means such as adhesion to not only prevent the device 100 from sliding off the table, but also for aesthetic reasons and to prevent scratching of fine furniture. Such rubber feet or felt tabs are designated 29.

Figure 3:
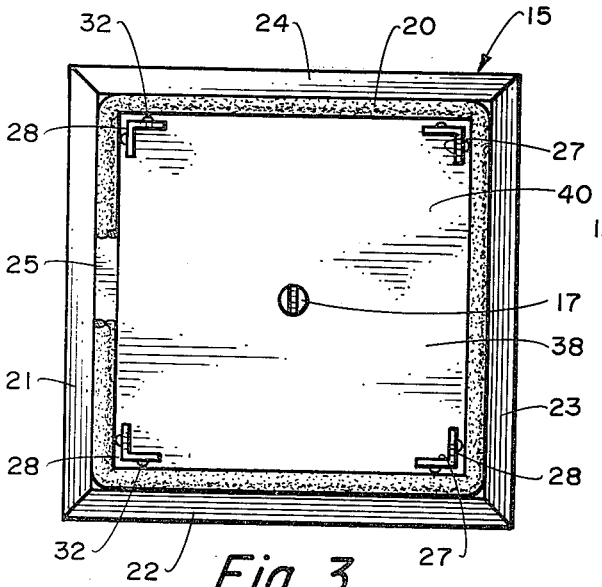
FIG. 3 is a bottom plan view of one portion of this invention.
Figure 5:
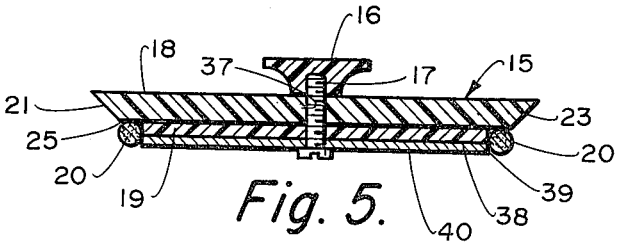
FIG. 5 is a sectional view of the top section of this invention.

As per FIGS. 1 and 5, top 15 includes a handle 16 which is attached to top portion 18 by bolt 17 which fastens thereto through bore 37 which extends through top section 18 and underplate 19, and connector plate 38. Reference is also made to FIG. 3, which shows 18 as a first plate & 19 as a second plate.

Figure 6:
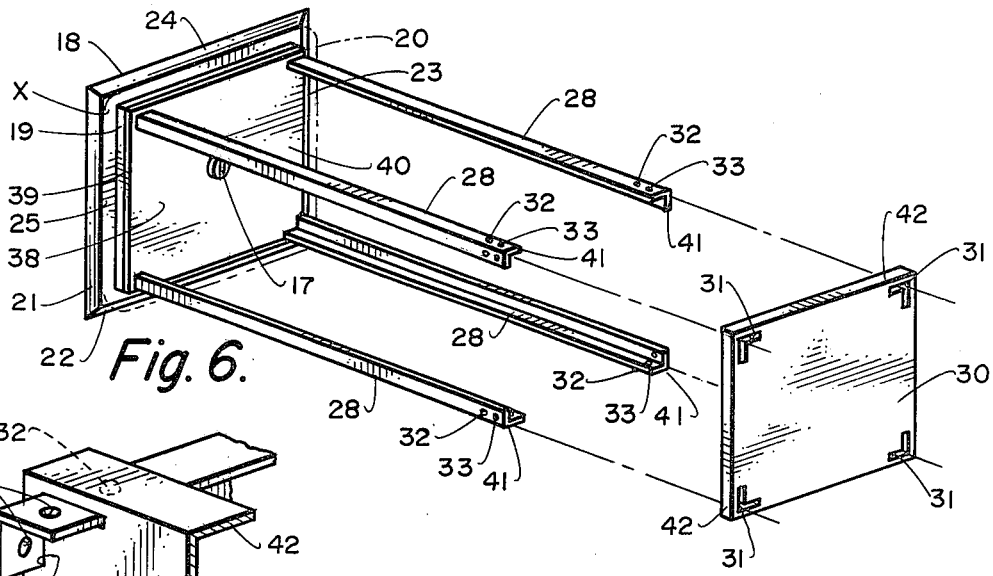
FIG. 6 is a fragmented perspective view of the top section of this invention.

FIG. 3 is seen to comprise a bottom plan view of top portion 15 without the L-rod sliders, and the resting plate 30 both of which are seen in FIG. 6. Connector plate 38, usually of metal, though plastic can be employed, has a main horizontal surface 40 which is spaced from underportion 19 by a circumferential upstanding lip or edge 39. It is held in abutting relationship to under portion 39 both by friction and bolt 17. L-slits 27 are adapted to receive L-sliders 28, which are secured in said slits by welding, adhesion or fusion if plastic is employed, normal to said connector plate 38 as is seen in FIG. 10.

Under-portion 19 is generally square or rectangular in conformance with the shape of the balance of top section 15. It is sized slightly smaller than the underside 25 of top portion 18 such as to be secured spaced inward from the edges a uniform amount on all four sides, per FIG. 5. Under portion 19 may be made integral with top portion 18 and may constitute a separate plate which is secured to the underside 25 of top portion 18 by any acceptable technique. In the space, designated X which corresponds to the distance that underportion 19 is spaced in from the edge of the underside 25, there is disposed a gasket 20, preferrably of circular cross-section. This gasket 20 is best secured in place by use of a suitable glue known to the art. Reference is made to FIGS. 5 and 6. Any suitable gasket material known to the art may be employed.

Figure 10:
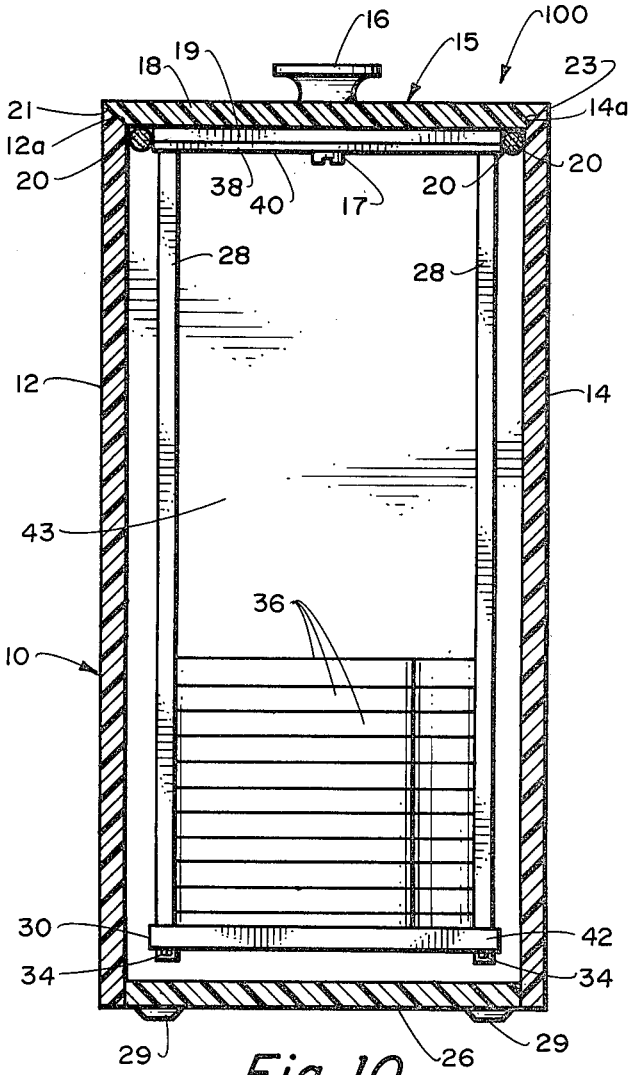
FIG. 10 is a vertical sectional view of the breadbox of this invention.

Top portion 18 is here of a square configuration, per FIG. 3 and is seen to have an underside 25 smaller than the top side thereof, due to the presence of a downward and inward, 21–24, chamfer, which chamfer is of the same general angle as the chamfers of the sidewalls, such as to have a sealing effect upon the placement of top portion 18 onto bottom section 10, per FIG. 10, which shows this in cross-section.

As previously mentioned, handle 16 of any suitable size and shape is mounted preferably in the middle of top portion 18.

L-sliders 28 are mounted normal to connector plate in slits 27, facing inwardly. In a square configuration for device 100, each slider is spaced equidistant from the two adjacent sliders, also in a square configuration. Each slider is mounted close to the corner of connector plate in order to accommodate as large a loaf, or part thereof, of bread in vertical fashion therebetween. (See FIG. 10). Spaced up from the bottom edge of each L-slider on each extremity of the L is a boss 32 which serves to give extra support surface for the L-slider in contact with resting plate 30. Each of said bosses is preferably about ¾" up from the bottom of the slider. In any event, all of the bosses 32 are equidistant from the bottom edge of said sliders.

Figure 7:
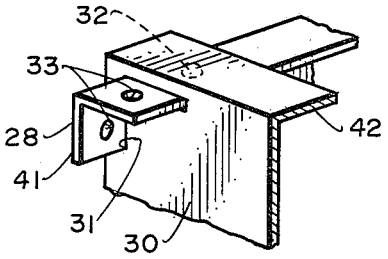
FIG. 7 is a fragmented closeup illustrating a portion of this invention.
Figure 8:
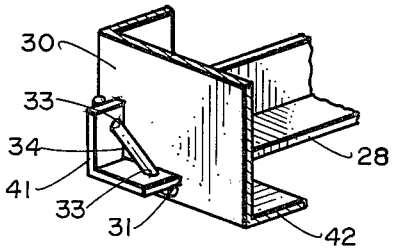
FIG. 8 is a view similar to FIG. 7.

Positioned along each extremity of all of said sliders between the bottom edge 41 and boss 32 is an aperture 33, best seen in FIG. 7, which is sized to accomodate a cotter pin 34 or other conventional fastener. To ensure proper mounting of the sliders and the easy slidability of the sliders within the compartment 43 of bottom section 10, each of said apertures 33 must be the same distance from the bottom of the fastener 41. See FIG. 8 which illustrates the disposition of a cotter pin 34 in said apertures 33 which serve as the mode of securing the L-sliders to the resting plate 30. The L-sliders 28 can be secured to the connector plate 38 in like fashion, or by solder or adhesive, or by heat welding.

Resting plate 30 includes upstanding flanges 42 around the perimeter thereof, about ¼" high which serve to keep the stacked slices or total loaf within the confines of said resting plate.

In each corner of plate 30 are L shaped slots 31 sized and spaced to receive all of said L-sliders. See FIG. 6. To assemble the resting plate to the L-sliders 28, each slider is inserted into its corresponding slot 31, the distance from edge 41 to boss 32. A cotter pin 34 or other suitable fastener is inserted into the two neighboring adjacent slots 33 whereby plate 30 rests on the four cotter pins 34.

It is to be recognized that this illustrates but one mode of attaching the four sliders to resting plate 30 such that said plate 30 is in parallel relationship to connector plate 38. Other such means include the use of adhesives, spot welding, heat for the fusion of plastic, with the mode being employed being dependent upon the materials utilized for the L-sliders and the resting plate 30, as well as the material used in connector plate 38.

In FIG. 9 there are shown several slices of bread 36 stacked up on the resting plate 30. The balance of top section 15 is not shown, for ease of comprehension.

FIG. 10 illustrates the operating principle of this device. It is seen that top section 15 is slidingly inserted into and onto bottom section 10. The L-sliders 28 slide into compartment 43, while the chamfered edge of top portion 18 comes to rest upon the corresponding chamfered edge of bottom section 10. By being located at X, gasket 20 abuts the interior of each of walls 11,12,13, and 14 to seal out external air to keep the bread 36 fresh. Though alluded to previously without being stated, it is seen that L-sliders 28 are are sized lengthwise in relation to the elevation of the sidewalls 11 etc. By not permitting either the L-sliders 28 or resting pan 30 to rest upon bottom wall 26, all of the downward thrust due to gravity causes the chamfered edges 11A,12A,13A and 14A to engage edges 21,22,23 and 24, which engagement coupled with the air seal present from the frictional engagement of gasket 20 with the interior surfaces of the side walls tends to extend the freshness period of bread stored therein.

It is seen that I have provided an improved vertical breadbox, which though shown in a square cross-section can just as easily be provided with a rectangular or even a circular crossection. It is within the skill of the art to modify the parts aforementioned to operate in such a configuration.

The use of the instant device permits the airtight storage of bread slices which are readily removeable from between the several L-sliders after they are placed there. One can dispense with the plastic wrap bag in which the bread is purchased thus also doing away with the burden of tieing and untieing the little wire that acts as a closure. In addition to instant access to the bread, youngsters who lack nimble fingers can obtain a slice of bread when they want it. Valuable drawer space or refrigerator space is saved, and the bread doesn't get cold in the process of being stored for freshness. Most importantly, the instant device in addition to being useful is decorative such that it can be carried from kitchen counter and placed on the table for use in conjunction with the finest bone china on any dining table.

I claim:

1. A vertical breadbox or other receptacle having a top section and a bottom section; said bottom section comprising a hollow body having four upstanding side walls normal to a bottom wall, each upstanding wall being normal to the next adjacent side wall, such that said breadbox is of square or rectangular cross-section and open at the top thereof, the top edge of each side wall tapering downwardly and inwardly at a defined angle, the top section of which is adapted to slidably rest within said bottom section and which comprises a generally flat first plate, the edges of which taper downwardly and inwardly at the same angle as the side wall taper, a second plate sized slightly smaller secured beneath said first plate, and a connector plate under mounted on said second plate, sized the same as said second plate, four L-sliders having first and second ends mounted normal to said connector plate, at one end of said L-sliders, a resting plate secured to each of said sliders at the second end of said sliders, said resting plate being disposed parallel to said connector plate, and adapted to float inside said hollow body, due to the elevation of said sliders being less than the elevation of said side walls, whereby said top section removably sealingly engages said bottom section.

2. The breadbox of claim 1 having rubber feet on the underside of the bottom wall of said bottom section.

3. The breadbox of claim 1 further including a gasket mounted on the underside of said first plate between each edge thereof and the respective edges of said second plate.

4. The breadbox of claim 1 including a handle secured to the top section.

5. The breadbox of claim 1 wherein the cross-section of the top section and the bottom section is square.

6. The breadbox of claim 1 wherein the cross section of said top section and bottom section is rectangular.

7. The breadbox of claim 5 wherein a gasket is mounted around the periphery of the underside of said first plate between each edge thereof and the edge of the respective side of said second plate.

* * * * *